United States Patent [19]

Chu et al.

[11] 4,090,880

[45] May 23, 1978

[54] LITHOGRAPHIC PRINTING PLATE AND METHOD OF MAKING SAME

[75] Inventors: Simon Long Chu, Dobbs Ferry; Eugene Golda, Monsey; Alan Leonard Wilkes, Brewster, all of N.Y.

[73] Assignee: Polychrome Corporation, Yonkers, N.Y.

[21] Appl. No.: 774,008

[22] Filed: Mar. 3, 1977

[51] Int. Cl.[2] ..... G03C 1/94

[52] U.S. Cl. ..... 96/86 R; 96/33; 96/86 P; 204/38 A; 204/42; 204/58

[58] Field of Search ..... 96/86 P, 86 R; 204/38 A, 42, 58

[56] References Cited

U.S. PATENT DOCUMENTS

| | | | |
|---|---|---|---|
| 3,307,951 | 3/1967 | Adams | 96/86 R |
| 3,321,385 | 5/1967 | Fazzari | 96/86 R |
| 3,330,743 | 7/1967 | Jestl et al. | 96/86 R |
| 3,440,050 | 4/1969 | Chu | 96/86 P |
| 3,511,661 | 5/1970 | Rauner et al. | 96/86 R |
| 3,873,318 | 3/1975 | Sheasby et al. | 96/86 P |
| 3,878,056 | 4/1975 | Yanagida et al. | 204/38 A |
| 3,891,516 | 6/1975 | Chu | 96/86 P |
| 3,975,197 | 8/1976 | Mikelsons | 96/86 P |

*Primary Examiner*—Jack P. Brammer

[57] ABSTRACT

A method for preparing aluminum based lithographic printing plates which comprises treating at least one surface of an aluminum base sheet with an interlayer composition, thereafter anodizing the thus treated aluminun surface, optionally retreating the coated, anodized aluminum plate with another stratum of the interlayer composition and then applying to said surface a suitable light sensitive composition to yield the desired photosensitive lithographic printing plate of improved characteristics.

14 Claims, No Drawings

LITHOGRAPHIC PRINTING PLATE AND METHOD OF MAKING SAME

BACKGROUND OF THE INVENTION

This invention relates to a novel method for the production of presensitized lithographic printing plates and to the novel lithographic printing plates produced thereby. More particularly, this invention relates to a novel method of producing aluminum based photosensitive lithographic printing plates which comprises coating at least one surface of an aluminum base sheet with an interlayer composition, anodizing the thus treated aluminum surface, optionally retreating the coated anodized aluminum plate with another stratum of the interlayer composition and finally applying to said surface a suitable light sensitive coating to yield the desired photosensitive lithographic printing plate.

It is well recognized that the substantial majority of photosensitive lithographic printing plates now produced are made from an aluminum based sheeting. This aluminum sheeting has, over the years, been found to suffer from certain disadvantages which prevent the direct application of the light sensitive coating to the aluminum base sheet. It has been found that upon direct application of the light sensitive composition to the aluminum base sheet, and subsequent exposure thereof to light, and the removal of the non-imaged areas for the preparation of a lithographic printing plate, the resultant printing plate has many undesirable characteristics which render it unacceptable for commercial use in the printing industry. Among the disadvantages suffered by such plates can be included the fact that the removed non-image areas do not possess sufficient hydrophilic and oleophobic characteristics, and therefore on printing will pick up background imperfections which will be imprinted on the final copy. In addition, since the aluminum is a rather soft metal, it does not have the resistance properties to sustain long press runs where more than about 100,000 copies are required. Further, the characteristic of the aluminum surface is such that a problem is encountered in achieving a strong bond between the light sensitive composition and the aluminum base sheet thus causing the image area of the plate to be dislodged from the surface, and renders the printed copy imperfect.

Heretofore, in the production of metal presensitized lithographic printing plates, it had been found beneficial to treat the surface of the metal substrate sheet, with a protective interlayer substance which imparts beneficial characteristics to the final lithographic printing plate thus produced. The prior art teaches that it is desirable to treat the metal sheet substrate surface receiving the light sensitive coating material, which when exposed to light and developed becomes the printing surface of the printing plate, with an undercoating substance that forms a strong bond with the metal sheet substrate and with the light sensitive coating material.

Many such undercoating treatments are known in the art for manufacturing longer running lithographic plates, and can be used on the sheets of this invention. U.S. Pat. Nos. 3,160,506, 3,136,636, 2,946,683, 2,922,715, disclose a variety of suitable materials for undercoating bonding substances onto plates and methods for applying them. Alkali metal silicate, silicic acid, alkali zirconium fluoride and hydrofluozirconic acid solutions presently are the most important commercial bonding substances. Those materials substantially improve the bonding of the light sensitive coating to the underlying metallic base which otherwise generally tends to have inadequate affinity for the coating. Of the various known bonding materials, the Group IV-B metal fluorides, the alkali metal salts and the acids thereof are preferred. In particular, the alkali zirconium fluorides, such as potassium zirconium hexafluoride, and hydrofluozirconic acid disclosed in U.S. Pat. Nos. 3,160,506 and No. 2,946,683 are used for preparing aluminum bases to receive a light sensitive coating.

One method in particular which is disclosed in the Jewett et al, U.S. Pat. No. 2,714,066 issued July 26, 1955, involves the use of a silicious overcoating on the aluminum sheet surface which acts as an interlayer bonding the photosensitive composition to the aluminum sheet surface. However, it has been found that this method does not completely solve the problem of bonding strength in that the bonding between the photosensitive composition and the aluminum base sheet has been found not to be strong enough to withstand long press runs, and in addition, tends to wear out or fail over an extended period of time.

The instant invention provides a novel method of manufacturing presensitized lithographic plates wherein a suitable interlayer composition such as have been hereinabove mentioned is coated directly to the surface of an aluminum sheet substrate, which may have previously been grained or etched. The coated substrate is subsequently electrolytically anodized, for example, in an aqueous sulfuric acid bath and then coated with a suitable lithographic photosensitive composition which is well known in the art.

According to the requirements of the present invention, the interlayer composition must be coated upon a substrate surface which is substantially free of any artificially produced oxide coating, for example, an anodic coating.

The resulting lithographic plate demonstrates a substantially extended shelf life, a protracted press life and improved clarity of the resultant printed image with improved oleophobic characteristics revealed in the non-image plate areas.

As another embodiment of the present invention, the coated, anodized aluminum substrate may again be coated with one of the above mentioned interlayer compositions prior to applying the photosensitive coating. This "sandwich" process exhibits even more profound beneficial characteristics of extended shelf life, press life, and clarity of image with improved oleophobic characteristics in the non-image plate areas.

PRIOR ART

As previously mentioned, a number of interlayer pretreatments are known in the art but these differ materially from the present invention.

U.S. Pat. No. 3,160,506 issued to O'Conner and Chu discloses a method for preparing planographic printing plates employing a wide choice of interlayer compositions, however, it does not teach the step of subsequently anodizing the interlayer composition coated substrate as revealed in the present application.

Similarly, U.S. Pat. No. 2,922,715 issued to Gumbinner, and U.S. Pat. No. 2,946,683 issued to Mellan and Gumbinner teach hardening the interlayer surface with an organic acid such as citric acid or tartaric acid, but no subsequent anodizing operation.

U.S. Pat. No. 3,136,636 issued to Dowdall and Case reveal a polyacid organic intermediate layer, but again, no subsequent anodizing is performed.

U.S. Pat. No. 3,181,461 issued to Fromson teaches applying a silicate coating on aluminum sheet having an aluminum oxide coating thereon preferably deposited as the result of anodizing the aluminum sheet in sulfuric acid.

British Pat. No. 884,110 issued to Polychrome Corporation discloses the treatment of a grained and/or etched aluminum surface with a zirconium hexahalide interlayer but does not provide for a post treatment anodizing.

U.S. Pat. No. 3,280,734 issued to Fromson reveals the sealing of an aluminum sheet having an aluminum oxide layer, preferably formed by anodizing, with a suitable bichromate or oxalate material.

British Pat. No. 1,031,263 issued to Polychrome Corporation teaches sealing the surface of a metal plate with a hydrophilic fluoride-chromic acid composition.

Importantly, all prior art teachings require a pure, clean and uncoated aluminum surface before the surface can be satisfactorily anodized. The following references are cited to demonstrate that only clean, uncoated surfaces are suitable for anodizing.

D. Gardner Foulke and W. B. Stoddard, Jr., "Anodizing", *Modern Electroplating,* edited by Frederick A. Lowenhein, John Wiley & Sons, Inc., New York. N.Y., 1942, P. 639. Teaches anodizing directly after cleaning, rinsing, and removing surface films principally through hot acid dips or an alkaline etch.

Dr. A. Jenn, *The Anodic Oxidation of Aluminum and its Alloys,* Chemical Publishing Company, New York, N.Y., 1940, P. 192, teaches degreasing with organic solvents, pickling in caustic soda, pickling in nitric acid and other such cleaning treatments before anodizing.

Dr. Ing. Alfred Von Zeerleder, *The Technology of Aluminum and Its Light Alloys,* Nordemann Publishing Company, New York, N.Y., 1963, P. 235 teaches degreasing in organic or inorganic agents and a nitric acid dip followed by a rinsing before anodizing.

S. Wernick and R. Pinner, *The Surface Treatment and Finishing of Aluminum and its Alloys,* 4th Edition, Robert Draper, Ltd., 1972, P. 370 and P. 491 et seq. teaches that anodizing requires a high degree of cleanliness of the metal to be treated. They also teach that the surface must be degreased, dismutted, treated in caustic soda and nitric acid followed by a rinse before anodizing.

As part of the present invention, we have unexpectedly found that it is possible to coat an aluminum surface with a lithographically suitable interlayer composition and anodize the aluminum sheet through this interlayer film. This was heretofore unknown and is a main feature of novelty in the instant invention. In practice, an aluminum sheet may, if desired, be subjected to the various cleaning treatments as heretofore described, however, a lithographically suitable interlayer composition such as an alkali silicate is coated on the aluminum surface prior to electrolytically anodizing in, for example, a sulfuric acid electrolyte. A lithographic plate produced with such a coated, anodized aluminum substrate demonstrates improved shelf life, resistance to oxidation, and improved hydrophilic characteristics in the non-image areas when the plate is developed and employed on an off-set printing press.

Although many other prior art disclosures do not show the inclusion of an interlayer, plates manufactured according to these specifications demonstrate an inadequate adhesion of the photosensitive material to the base substrate and are unsatisfactory for long press runs. The desirability of such an interlayer for improved bonding and protection of the base is well known to the art.

The present invention substantially improves the bonding and protecting performance of these interlayers resulting in a concurrent increase in plate press life with a significant increase in the oleophobic propensities of the non-image plate areas.

SUMMARY OF THE INVENTION

The present invention provides a method of preparing an improved lithographic plate whereby a metal sheet substrate, preferably aluminum and the alloys thereof, which may have been grained or etched is coated with an interlayer composition such as those well known to the lithographic art. The thus coated substrate is subsequently subjected to electrolytic anodizing, for example, in a sulfuric acid bath. The thus treated substrate may then optionally be coated again with an interlayer composition, as hereinfore mentioned, before said coated substrate has a lithographically suitable photosensitive composition applied thereto.

It is therefore an object of the present invention to provide an improved method for treating a metal sheet substrate suitable for use as a base for a lithographic plate whereby said substrate is coated with a suitable interlayer composition and subsequently anodized prior to the application of a photosensitive composition.

It is a further object of the present invention to provide an improved method for treating a metal sheet substrate suitable for use as a base for a lithographic plate whereby the resultant lithographic plate manifests an increased shelf life and a prolonged press life.

It is another object of the present invention to provide a novel lithographic plate having improved image clarity.

It is still another object of the present invention to provide an improved lithographic printing plate which exhibits added bonding and protection between the metal sheet substrate and the photosensitive coating.

It is a still further object of the present invention to provide a lithographic printing plate which has added oleophobic properties in the non-image plate areas, thus providing a cleaner running plate over its lifetime.

These and other objects of this invention will be in part discussed and in part apparent upon examination of the detailed description of the preferred embodiment.

DETAILED DESCRIPTION OF THE PREFERRED EMBODIMENT

As the first step in the process of this invention, a sheet metal substrate, preferably aluminum and the alloys thereof especially those aluminum compositions suitable for the manufacture of lithographic printing plates such as Alcoa 3003 and Alcoa 1100, which may or may not have been pre-treated by standard graining and/or etching techniques as are well known in the art, is coated by spraying, brushing, dipping or other means with a composition suitable for use as an interlayer for lithographic plates. Standard metal substrate pretreatments include chemical etching, and chemical or mechanical graining by methods which are known to the skilled worker. Coating compositions employable in the practace of this invention include aqueous solutions of alkali silicate, silicic acid, the Group IV-B metal fluorides, the alkali metal salts, polyacrylic acid, the alkali zirconium fluorides, such as potassium zirconium hexafluoride, or hydrofluozirconic acid in concentrations of 0.5 to 20% by volume. A preferred concentration range is from 3 to 8% and the most preferred range is from 4 to 5%.

The coated metal sheet substrate is then electrolytically anodized by a method well known in the art such as, electrolytically treating the coated substrate in an aqueous solution of sulfuric, chromic, or phosphoric acid having a concentration of from about 0.5 to 25% by weight of acid in water. Anodizing preferably takes place in a bath maintained at a temperature of from about 15° C to 35° C for about from 1 to about 20 minutes at about from 5 to 20 volts and at a current density of about from 10 to 70 amperes per square foot.

It is to be understood that the foregoing parameters are necessarily interdependent and various combinations and modifications of said parameters are operable in the context of the present invention. The hereinfore mentioned parameters are specifically not intended to limit the scope of the instant invention.

Next, the coated, anodized substrate may, if desired, be coated again with an interlayer composition such as hereinbefore described, to afford the substrate an even greater measure of the beneficial properties previously enumerated. The resulting metal sheet substrate may then be coated with a photosensitive composition suitable for lithographic purposes. The photosensitive compositions which may be satisfactorily employed in the practice of this invention are those which are lithographically suitable and are actinic and ultraviolet light reactive. The photosensitive compositions which may be employed in the practice of this invention are those which are negative or positive acting and include such negative acting photosensitive agents as, the azidopyrenes, for example, 1-azidopyrene, 6-nitro-1-azidopyrene, 1,6-diazidopyrene, 1,8-diazidopyrene, 1-propionyl-6-azidopyrene, 1-acetyl-6-azidoyprene, 1-n-butyryl-6-azidopyrene, 1-n-propionyl-8-bromo-6-azidopyrene, 6-n-propionyl-1-azidopyrene-8-sulfonic acid and 8-n-propionyl-1,6-diazidopyrene; and such positive acting photosensitive agents as aromatic diazo-ozide compounds, for example, benzoquinone diazides, naphthoquinone diazides, and polyacetals which depolymerize under ultraviolet radiation, polymonochloroacetaldehyde, polypropionaldehyde, poly-n-butyraldehyde, poly-cyanoacetaldehyde, poly-B-cyanopropionaldehyde, polyisobutyraldehyde, poly-valeraldehyde, polyheptaldehyde. The most satisfactory photosensitive agent may be selected by the skilled worker, depending upon the results sought to be achieved.

The optimum proportion of each ingredient and selection of particular composition naturally depends on the specific properties desired in the final lithographic plate. It has been found that on the average, lithographic plates made in accordance with the present invention display a 33⅓% to 300% increase in shelf storage life.

The thus produced lithographic plate, when exposed and developed, demonstrates improved image stability, an increase in the hydrophilic propensities of the non-image areas, and thus is a much cleaner running plate over its useful lifetime.

The following examples are provided to illustrate the operation of the present invention and in no way limits its scope.

EXAMPLE 1

Three sheets of Alcoa 3003 aluminum foil were degreased and chemically etched in a 4% trisodium phosphate bath maintained at 180° F with subsequent desmutting in a 40% nitric acid bath for 30 seconds at 90° F. The aluminum sheets were then rinsed with water.

Sheet "A" was anodized in an 18% sulfuric acid bath maintained at 80° F and 16 amp-min/sq.ft. and rinsed with water.

Sheet "B" was submerged for 1 minute in a 1% potassium zirconium fluoride solution at 180° F, rinsed with water and then anodized as sheet "A".

Sheet "C" was first anodized as sheet "A" and then submerged in a 1% potassium zirconium fluoride solution at 180° F with a subsequent water rinse.

The above samples were thereafter coated with a negative acting light sensitive lithographic coating, consisting of 4 parts paradiazo diphenol amine resin salt of hydroxy benzophenone sulfonic acid and 1 part Epon 1031 epoxy resin available from Shell Oil Company, in methyl cellosolve. The samples were coated at a weight of 65 mg/sq.ft. and the thus formed plates subjected to accelerated shelf life testing.

Sheet "B", made according to the method of the present invention demonstrated satisfactory image producing quality after a simulated 18 month shelf life. Sheet "A" showed inconsistent image producing quality after only a 6 month simulated life test while sheet "C" demonstrated inconsistent image producing quality after a 12 month accelerated life test. Thus sheet "B" of the instant invention displayed a 200% and a 50% increase in shelf life respectively as compared to plates "A" and "C".

EXAMPLE 2

Three sheets of Alcoa 3003 aluminum foil were degreased and chemically etched in a 4% trisodium phosphate bath maintained at 180° F with subsequent desmutting in a 40% nitric acid bath for 30 seconds at 90° F. The aluminum sheets were then rinsed with water.

Sheet "A" was anodized in an 18% sulfuric acid bath maintained at 80° F and 16 amp-min/sq.ft. and rinsed with water.

Sheet "B" was submerged for 1 minute in a 5% sodium silicate solution at 180° F, rinsed with water and then anodized as sheet "A".

Sheet "C" was first anodized as sheet "A" and then submerged for one minute in a 5% sodium silicate solution at 180° F with subsequent water rinse.

The above samples were thereafter coated with a negative acting light sensitive lithographic coating, consisting of 4 parts paradiazo diphenol amine resin salt of hydroxy benzophenone sulfonic acid and 1 part of Goodrich's polyurethane ESTANE 5714 in methyl cellosolve. The samples were coated at a weight of 50 mg./sq.ft. and the thus formed plates subjected to ccelerated shelf lift testing.

Sheet "B", made according to the method of the present invention demonstrated satisfactory image producing quality after a simulated eighteen month shelf life. Sheet "A" showed inconsistent image producing quality after only a 6 month simulated life test while sheet "C" demonstrated inconsistent image producing quality after a 12 month accelerated life test. Thus sheet "B", prepared by the method of the instant invention displayed a 200% and a 50% increase respectively in shelf life as compared to plates "A" and "C".

EXAMPLE 3

Three sheets of Alcoa 1100 aluminum foil were degreased in a 4% trisodium phosphate and mechanically grained.

Sheet "A" was anodized in an 18% sulfuric acid bath maintained at 80° F and 16 amp-min/sq.ft. and rinsed with water.

Sheet "B" was first anodized as sheet "A" and then submerged for 1 minute in a 5% sodium silicate solution at 180° F with a subsequent water rinse.

Sheet "C" was submerged for 1 minute in a 1% sodium silicate solution at 180° F, rinsed with water and then anodized as sheet "A". The sheet was then submerged again in the sodium silicate bath for 1 minute and rinsed with water, thus forming a "sandwich" treatment.

The above samples were thereafter coated with a negative acting light sensitive lithographic coating, consisting of 4 parts paradiazo diphenol amine resin salt of hydroxy benzophenone sulfonic acid and 20 parts of Monsanto's Formula 12/85 Resin in methyl cellosolve. The samples were coated at a weight of 80 mg./sq.ft. and the thus formed plates subjected to accelerated shelf lift testing.

Sheet "C" made according to the method of the present invention demonstrated satisfactory image producing quality after a simulated 24 month shelf life. Sheet "A" showed inconsistent image producing quality after only a 6 month simulated life test while sheet "B" demonstrated inconsistent image producing quality after an 18 month accelerated life test. Thus sheet "C" prepared according to the method of the present invention demonstrates respectively a 300% and a 33% increase in shelf life as compared to plates "A" and "B".

EXAMPLE 4

Two sheets of Alcoa 3003 aluminum were degreased in a 5% solution of trisodium phosphate and were mechanically grained by wire brushing.

Sample "A" was anodized in an 18% acid bath maintained at 80° F and 16 amp-min/sq.ft. to obtain an anodic coating weight of approximately 200 mg./sq.ft.

Sample "B" was then bathed in a 2% solution of sodium silicate maintained at 180° F and then anodized as sample "A".

The above samples were thereafter coated with a positive acting light sensitive lithographic coating consisting of 1 part of a quinone diazide composition and 1 part Bakelite 2620, available from Union Carbide, in Methyl Cellosolve. The plates were coated at a weight of 200 mg./sq.ft., exposed and developed according to procedures well known to the skilled worker. Each plate was mounted on a conventional printing press and produced acceptable copies. The presses were subsequently stopped and both plates left on the presses overnight without any additional treatment. Reprinting was begun with each plate the following morning and it was noticed that ink was attracted to the non-imate areas of plate "A" due to aluminum oxidation whereas plate "B", produced according to the method of the present invention, did not so attract ink in the non-image areas and continued to print clean images. This beneficial quality of plate "B" is due to the hydrophilic sodium silicate treatment and subsequent anodizing which retarded oxidation.

It must be further noted that heretofore it has not been possible to use an interlayer coating with a positive acting lithographic sensitizer since the tenacity of the interlayer for the photosensitizing agent did not permit adequate development after exposure. The present invention reveals a method whereby an interlayer may be coated on a lithographically suitable aluminum sheet prior to applying a positive acting lithographic sensitizer.

It is, of course, to be understood that the foregoing disclosure is intended to illustrate the invention and that numerous changes can be made in the ingredients, conditions and proportions set forth without departing from the scope of the invention as disclosed and defined in the claims appended hereafter.

We claim:

1. A method for preparing lithographic printing plates which comprises coating at least one surface of a metal sheet substrate, which surface is substantially free of anodic coating, with a suitable interlayer composition, wherein the interlayer composition is an aqueous solution whose solute is a substance selected from the group consisting of an alkali silicate, silicic acid, Group IV-B metal fluoride, polyacrylic acid, and alkali metal salt, then electrolytically anodizing the thus coated metal sheet substrate, optionally again coating the thus coated and anodized substrate with another stratum of said suitable interlayer composition and then applying to the thus treated substrate a lithographically suitable photosensitizing agent.

2. The lithographic printing plate obtained by the method of claim 1.

3. The method of claim 1 wherein the metal sheet substrate is comprised of aluminum.

4. The method of claim 1 wherein the coated metal sheet substrate is anodized in an aqueous acid selected from the group consisting of sulfuric, chromic, and phosphoric acid having a concentration of from about 0.5 to 25% by weight of acid in water at a temperature of from about 15° C to 35° C for about 1 to about 20 minutes at about from 5 to 20 volts and at a current density of about from 10 to 70 amperes per square foot.

5. The method of claim 1 wherein the photosensitizing agent is a composition selected from the group consisting of aromatic diazo compounds, azidopyrenes, benzoquinone diazides, naphthoquinone diazides, polyacetals which depolymerize under ultraviolet radiation, polymonochloroacetaldehyde, polypropionaldehyde, poly-n-butyraldehyde, poly-cyano-acetaldehyde, poly-B-cyanopropionaldehyde, poly-cyano-pentaldehyde, polycyanovaleraldehyde, poly-n-butyraldehyde, polyisobutyraldehyde, polyvaleraldehyde and polyheptaldehyde.

6. The method according to claim 1 wherein the solute of the aqueous interlayer composition is sodium silicate.

7. The method according to claim 1 wherein the solute of the aqueous interlayer composition is potassium zirconium fluoride.

8. A method for preparing lithographic printing plates which comprises coating at least one surface of a metal sheet substrate, which surface is substantially free of anodic coating, with a suitable interlayer composition, wherein the interlayer composition is an aqueous solution whose solute is a substance selected from the group consisting of an alkali silicate, silicic acid, Group IV-B metal fluoride, polyacrylic acid, and alkali metal salt in concentrations of from about 0.5 to about 20% by volume, then electrolytically anodizing the thus coated metal sheet substrate, optionally again coating the thus coated and anodized substrate with another stratum of said suitable interlayer composition and then applying to the thus treated substrate a lithographically suitable photosensitizing agent.

9. The lithographic printing plate produced according to the method of claim 3.

10. The lithographic printing plate produced according to the method of claim 4.

11. The lithographic printing plate produced according to the method of claim 5.

12. The lithographic printing plate produced according to the method of claim 6.

13. The lithographic printing plate produced according to the method of claim 7.

14. The lithographic printing plate produced according to the method of claim 8.

* * * * *